US005242655A

United States Patent [19]

Holmberg

[11] Patent Number: 5,242,655

[45] Date of Patent: Sep. 7, 1993

[54] STAINLESS STEEL

[75] Inventor: Hakan Holmberg, Gävle, Sweden

[73] Assignee: Sandvik A.B., Sandviken, Sweden

[21] Appl. No.: 895,426

[22] Filed: Jun. 5, 1992

Related U.S. Application Data

[63] Continuation of Ser. No. 660,999, Feb. 26, 1991, abandoned.

[30] Foreign Application Priority Data

Feb. 26, 1990 [SE] Sweden ..... 9000673

[51] Int. Cl.[5] ..... C22C 38/58

[52] U.S. Cl. ..... 420/48; 420/54

[58] Field of Search ..... 420/48, 54

[56] References Cited

U.S. PATENT DOCUMENTS 3,592,634 7/1971 Denhard, Jr. ..... 420/48

4,441,926 4/1984 Hiraishi et al. ..... 420/48

FOREIGN PATENT DOCUMENTS 934836 11/1955 Fed. Rep. of Germany .

61-261463 11/1986 Japan .

936872 9/1963 United Kingdom .

1365773 9/1974 United Kingdom .

*Primary Examiner*—Deborah Yee

*Attorney, Agent, or Firm*—Burns, Doane, Swecker & Mathis

[57] ABSTRACT

The invention relates to a high strength, vanadium-containing stainless steel alloy in which the amounts of the alloy elements have been balanced such that the austenite phase remains stable without being deformed into martensite even under large reductions. The steel alloy comprises 0.04–0.25% C, 0.1–2% Si, 2–15% Mn, 16–23% Cr, 8–14% Ni, 0.10–1.5% N, 0.1–2.5% V, the remainder being iron and normal impurities.

18 Claims, No Drawings

STAINLESS STEEL

This application is a continuation of application Ser. No. 07/660,999, filed Feb. 26, 1991, now abandoned.

The invention relates to a non-magnetic, high strength austenitic stainless steel in which the austenite phase is sufficiently stable as to resist transformation into the ferromagnetic martensite phase even under substantial reduction, for instance by cold rolling of strips or drawing of wire.

The rapid development within the computer and electronic industries has created an increased demand for materials with combinations of properties not considered earlier or easily achievable, for example, the combination of high mechanical strength and non-magnetic structure for materials to be used in spring applications where the material must be magnetically inert. For many such products, the manufacturing process includes various forming, (e.g., reducing) steps. Since it is common knowledge that increased strength leads to impaired ductility, it is of substantial advantage if the forming steps can be carried out in as soft condition as possible and the requisite strength ultimately needed can be achieved by a simple heat treatment.

Among high strength stainless steels, the so-called non-stable austenitic spring steels SS 2331 with the typical nominal analysis 17Cr, 7Ni, 0.8Si, 1.2Mn, 0.1C and 0.03N are in a special position because of their combination of high strength and good corrosion properties.

The very high strength achievable with this type of steel depends from the (para-magnetic) austenitic structure which during deformation transforms into (ferromagnetic) martensite, a phase of exceptional hardness. When the amount of alloying elements (primarily Ni and Mo) are increased such as in type SS 2343/2353, the tendency for the formation of deformation martensite is reduced but the possibility of achieving high strength is thereby also reduced.

Due to a systematic research effort, it has now been found possible, by carefully balancing the alloying elements and by cold working to achieve a work hardening effect while preserving a non-magnetic structure. In addition thereto it is found possible, without affecting the magnetic properties, to precipitation harden the alloy to high strength by a simple heat treatment.

The strictly controlled optimized composition (in weight-%) of the alloy of this invention in its broadest aspect comprises the following analysis:

| | |
|---|---|
| C | 0.04–0.25 |
| Si | 0.1–2 |
| Mn | 2–15 |
| Cr | 16–23 |
| Ni | 8–14 |
| N | 0.10–1.5 |
| V | 0.1–2.5 |

the remainder being iron and normal impurities.

The amounts of alloying elements, which are very critical, are governed by microstructural requirements which comprises an austenitic matrix with inclusions of vanadium nitrides. The microstructure should not include any ferrite. The austenite phase should be sufficiently stable that it is not, to any significant degree, transformed into ferromagnetic martensite during cooling from high temperature annealing or by substantial cold working, typically >70% thickness/reduction by cold rolling or a corresponding degree of reduction by wire drawing. At the same time, the austenite phase shall exhibit a substantial cold hardening during deformation which means that high mechanical strength is achieved without the presence of ferromagnetic phase. It is also important to increase the strength in the cold rolled condition by a simple heat treatment. In order to achieve these objectives, at the same time the effects of the various alloy elements upon the material properties must be known. Certain of these alloy elements are ferrite formers and others are austenite formers at temperatures that are relevant for hot working and annealing. Further, certain of these element contribute positively to deformation hardening during cold working whereas others decrease the same.

The effects of the various alloy elements and an explanation of the limitations thereof is described below where the amounts are given in weight-%.

Carbon is an element which strongly contributes to austenite formation. Carbon also contributes to the stabilization of the austenite against martensite transformation and it has consequently a double positive effect in this alloy. Carbon also positively contributes to work hardenability during cold working. The carbon content should therefore exceed 0.04%. High carbon amounts, however, leads to negative effects. Its high chromium affinity results in an increased tendency for carbide precipitation with increased carbon content. This also leads to impaired corrosion properties, embrittlement problems and a destabilization of the matrix which might lead to local martensite transformation which renders the material being partially ferromagnetic. The maximum content of C is therefore limited to 0.25%, preferably below 0.20%.

Si is an important element for the purpose of facilitating the manufacturing process. The amount of Si should therefore be at least 0.1%. Si is, however, a ferrite stabilizer which rather drastically tends to increase the tendency for the formation of the ferromagnetic phase of ferrite. High Si amounts additionally promote the tendency to precipitate easily melting intermetallic phases and thereby impair the hot working. The Si-content should therefore be limited to max 2%, preferably max 1.0%.

Manganese has been found to contribute positively to several properties of the alloy of this invention. Mn stabilizes austenite without simultaneously negatively affecting the work hardening. Mn has the additional important ability of providing increased solubility of nitrogen, properties described more specifically hereunder, both in the melted and solid phase. The Mn content should therefore exceed 2% and preferably exceed 4%. Mn increases the coefficient of linear expansion and reduces electrical conductivity which could be of disadvantage for applications within electronics and computer areas. High amounts of Mn also reduce corrosion resistance in chloride containing environments. Mn is also much less efficient than nickel as a corrosion reducing element under oxidizing corrosion conditions. The Mn content should therefore not exceed 15% and should preferably amount to 4–10%, and more preferably 4.0–7.5%.

Cr is an important alloying element from several aspects. Cr content should be high in order to achieve good corrosion resistance. Cr also increases the nitrogen solubility both in the melt and in the solid phase and thereby enables the increased presence of nitrogen in the alloy. Increased Cr content also contributes to the stabilization of the austenite phase against martensite transformation. The alloy of the present invention can, to advantage, as described below be subject of precipitation hardening and precipitate high chromium containing nitrides. In order to reduce the tendency for excessive local reduction of Cr-content with concomitant non-stabilization of the austenite phase and reduction in corrosion resistance the Cr content should exceed 16%.

Since Cr is a ferrite stabilizing element, the presence of very high Cr contents will lead to the presence of ferromagnetic ferrite. The Cr content should therefore be equal to or less than 23%, preferably equal to or less than 21%.

Ni is, next after carbon and nitrogen, the most efficient austenite stabilizing element. Ni also increases austenite stability against deformation into martensite. Ni is also, in contrast of Mn, known efficiently contributing to corrosion resistance under oxidizing conditions. Ni is, however, an expensive alloying element and at the same time has a negative impact on work hardening during cold working. In order to achieve a sufficiently stable non-magnetic structure the Ni-content should exceed 8%. In order to achieve high strength after cold working the Ni-content should not exceed 14%, preferably not exceed 12% but preferably exceed 9%.

N is a central alloy element in the present alloy. N is a strong austenite former, promotes solution hardening and stabilizes the austenite phase strongly against deformation into martensite. N is also advantageous for achieving increased work hardening at cold working and it acts as a precipitation hardening element during heat treatment. Nitrogen can therefore contribute to a further increase of the cold rolled strength.

Nitrogen also increases the resistance of the alloy to nodular corrosion. Chromium nitrides precipitated during heat treatment also appear to be less sensibilizing than corresponding chromium carbides.

In order to completely take advantage of its many good properties, the N content should not be less than 0.10%, preferably not less than 0.15%.

When using very high nitrogen contents, the solubility of N is exceeded in the melt. The N content should therefore not exceed its solubility in the melt and be equal to or less than 1.5%, and preferably amount to max 0.6%, more preferably 0.2–0.5%.

Vanadium is an element having several positive effects. Vanadium increases the solubility of nitrogen and contributes to the formation of vanadium nitrides which promote fine grain formation during heat treatment. By optimizing the heat treatment, the mechanical properties can also be improved by precipitation hardening. The content of V should be at least 0.1%, preferably higher than 0.25%. V is also a ferrite stabilizing element and its content should therefore not exceed 2.5%, preferably max 2.0%.

The invention will in the following be disclosed by way of results from research carried out whereby further details about structure, work hardening, mechanical properties and magnetic properties will be disclosed in connection with the following Example which is to be considered as illustrative of the present invention. It should be understood, however, that the invention is not limited to the specific details of the Example.

EXAMPLE

Production of the testing materials included melting in a high-frequency induction furnace and casting to ingots at about 1600° C. These ingots were heated to about 1200° C. and hot worked by forging the material into bars. The materials were then subjected to hot rolling into strips which hereafter were quench annealed and clean pickled. The quench anneal was carried out at 1080°–1120° C. and quenching occurred in water.

The strips obtained after quench annealing were then cold rolled to various amounts of reduction after which test samples were taken out for various tests. In order to avoid variations in temperature and their possible impact on magnetic properties the samples were cooled to room temperature after each cold rolling step.

The chemical analysis of the testing materials in weight-% appears from Table 1 below:

TABLE 1

Chemical analysis, in weight-%, of test materials.

| Steel No. | C | Si | Mn | Cr | Ni | N | V |
|---|---|---|---|---|---|---|---|
| 875* | .20 | .56 | 4.20 | 18.03 | 8.97 | 0.29 | 0.94 |
| 876* | .058 | .54 | 5.06 | 20.37 | 10.00 | 0.40 | 1.57 |
| 877* | .018 | .60 | 13.1 | 19.20 | 9.00 | 0.42 | 1.64 |
| 879* | .057 | .51 | 2.15 | 20.03 | 12.03 | 0.30 | 0.51 |
| 900* | .014 | .64 | 14.0 | 19.1 | 9.10 | 0.51 | 1.01 |
| 880** | .052 | .89 | 3.82 | 20.25 | 10.01 | 0.29 | — |
| 866** | .11 | .83 | 1.49 | 18.79 | 9.47 | 0.20 | — |
| AISI** 304 | .034 | .59 | 1.35 | 18.56 | 9.50 | 0.17 | — |
| AISI** 305 | .042 | .42 | 1.72 | 18.44 | 11.54 | 0.036 | — |

P,S < 0.030 weight-% is valid for all alloys above.
*alloys of the invention
**comparison samples Samples were taken in quench annealed condition for control of ferrite and martensite content and for hardness measurement. The results are disclosed in Table 2.

TABLE 2

Microstructure for test materials in annealed hot rolled strips.

| Steel No. | annealing temperature | ferrite % | martensite % | hardness Hv |
|---|---|---|---|---|
| 875* | 1120 | 0 | 0 | 245 |
| 876* | " | 0 | 0 | 223 |
| 877* | " | 0 | 0 | 222 |
| 879* | " | 0 | 0 | 220 |
| 900* | " | 0 | 0 | 240 |
| 880** | 1080 | 0 | 0 | 195 |
| 866** | " | 0 | 0 | 186 |
| AISI 304** | " | 0 | 0 | 174 |
| AISI 305** | " | 0 | 0 | 124 |

*alloys of the invention
**comparison samples

All these test alloys fulfill the requirement of being free from ferrite and martensite in the quench annealed condition. The annealed hardness is somewhat higher than that of the reference materials AISI 304/305.

As described above, it is very essential that the materials of this invention exhibit a substantial work hardening during cold working operation. After cold rolling to 75% thickness reduction, samples were taken for hardness measurement. Table 3 shows increase in hardness as a function of cold working.

TABLE 3

| Steel No. | 875 * | 876 * | 877 * | 879 * | 900 * | 880 ** | 866 ** | AISI304 ** | AISI305 ** |
|---|---|---|---|---|---|---|---|---|---|
| | Vickers hardness of test alloys at 75% cold deformation amount. | | | | | | | | |
| quench annealed | 245 | 223 | 222 | 220 | 239 | 195 | 186 | 174 | 124 |
| 75% def | 485 | 445 | 430 | 447 | 459 | 448 | 440 | 430 | 385 |

*alloys of the invention
**comparison samples

All these testing alloys appear to have a substantial deformation hardening compared with reference materials AISI 304/305.

The strength of the alloys by uniaxial tensile testing as a function of the amount of cold working is disclosed in Table 4 wherein $R_p$ 0.05 and $Rp_p$ 0.2 correspond to the load which gives 0.05% and 0.2% residual elongation, Rm corresponds to the maximum value of applied load in the load-elongation diagram and A10 corresponds with the ultimate elongation of the testing bar.

TABLE 4

Yield point, ultimate strength and elongation of test alloys.

| Steel No. | Condition | | $R_p$0.05 MPa | $R_p$0.2 MPa | Rm MPa | A10 % |
|---|---|---|---|---|---|---|
| 875* | 75% | red | 1092 | 1500 | 1735 | 3 |
| 876* | " | " | 984 | 1357 | 1572 | 4 |
| 877* | " | " | 924 | 1296 | 1540 | 5 |
| 879* | " | " | 997 | 1361 | 1568 | 4 |
| 900* | " | " | 1021 | 1415 | 1670 | 4 |
| 880** | " | " | 985 | 1343 | 1566 | 4 |
| 866** | " | " | 997 | 1356 | 1558 | 4 |
| AISI** 304 | " | " | 910 | 1300 | 1526 | 5 |
| AISI** 305 | " | " | 868 | 1177 | 1338 | 5 |

*alloys of the invention
**comparison samples

Table 4 shows that by using alloys of this invention, very high strength levels can be achieved by cold working. Alloy AISI 305 appears to have a substantially slower work hardening probably due to its low amounts of interstitially dissolved alloy elements, i.e., nitrogen and carbon, combined with a rather high nickel content.

Spring steel of the type SS 233 is often annealed for the purpose of achieving an additional increase of its mechanical properties. This annealing contributes favorably to several important spring properties such as fatigue strength, relaxation resistance and the ability of forming this material in a rather soft condition. The high ductility at lower strength can hereby be used favorably to a more specific formation of the material.

Table 5 shows the effects of such annealing upon the mechanical properties after 75% cold reduction. The annealing tests gave as result an optimal effect at a temperature of 450°/500° C. and 2 hours maintenance.

TABLE 5

Yield point, ultimate strength and elongation after annealing 450/500° C./2h at 75% cold reduction. The figures in parenthesis indicate the change in percentage of strength values as a result of such anneal.

| Steel No. | Temperature C. | $R_p$0.05 MPa | $R_p$0.2 MPa | Rm MPa | A10 % |
|---|---|---|---|---|---|
| 875* | 500 | 1585 | 1853 | 1987 | 3 |
| | | (45) | (24) | (15) | |
| 876* | " | 1479 | 1715 | 1831 | 3 |
| | | (50) | (26) | (16) | |
| 877* | " | 1434 | 1665 | 1792 | 2 |
| | | (55) | (28) | (16) | |
| 879* | " | 1473 | 1694 | 1815 | 3 |
| | | (48) | (24) | (16) | |
| 900* | " | 1579 | 1825 | 1946 | 3 |
| | | (55) | (29) | (16) | |
| 880** | 450 | 1368 | 1598 | 1740 | 3 |
| | | (38) | (19) | (11) | |
| 866** | " | 1305 | 1565 | 1720 | 3 |
| | | (30) | (15) | (10) | |
| AISI** 304 | " | 1189 | 1470 | 1644 | 3 |
| | | (30) | (13) | (07) | |
| AISI** 305 | " | 1057 | 1260 | 1380 | 4 |
| | | (21) | (07) | (03) | |

*alloys of the invention
**comparison samples

The alloys of this invention appear to have obtained a very good effect as a result of the anneal. It is of specific importance to notice the extremely higher increase in the $R_p$ 0.05 value of 45–55%. this is the value that is best correlated with the elastic limit which is an indication of how much a spring can be loaded without being subject to plastification. By having reached such an increase in the $R_p$ 0.05 value, a larger work area can be used for a spring made of such material. It is of specific interest to notice the rather minor increase in ultimate strength in AISI 304 and AISI 305. This is an essential disadvantage since the ultimate strength by experience is the value that is best correlated with the fatigue strength.

For a material according to this invention it is the objective to achieve the objective of a high strength material at the same time as the material exhibits paramagnetic behavior, i.e., a magnetic permeability very close to 1. Table 6 discloses the magnetic permeability depending upon field strength the various alloys after 75% cold reduction and annealing at 450/500%/2 hours.

TABLE 6

Permeability values for testing alloys. Underlined values indicate maximal measured permeability. The value at the bottom indicates ultimate strength in corresponding condition.

| Field strength Oersted * | 875 * | 876 * | 877 * | 879 * | 900 * | 880 ** | 866 ** | AISI 304** | AISI 305 |
|---|---|---|---|---|---|---|---|---|---|
| | Steel No. | | | | | | | | |
| 50 | 1.0239 | 1.0111 | 1.0113 | 1.0049 | 1.0022 | 1.0099 | 1.0346 | 1.5231 | 1.059 |
| 100 | 1.0247 | 1.0111 | 1.0115 | 1.0055 | 1.0022 | 1.0118 | 1.0248 | 1.8930 | 1.066 |

TABLE 6-continued

Permeability values for testing alloys. Underlined values indicate maximal measured permeability. The value at the bottom indicates ultimate strength in corresponding condition.

| Field strength Oersted * | Steel No. 875 * | 876 * | 877 * | 879 * | 900 * | 880 ** | 866 ** | AISI 304** | AISI 305 |
|---|---|---|---|---|---|---|---|---|---|
| 150 | 1.0239 | 1.0112 | 1.0095 | 1.0051 | 1.0020 | 1.0115 | 1.0413 | 2.1056 | 1.068 |
| 200 | 1.0228 | 1.0103 | 1.0083 | 1.0044 | 1.0019 | 1.0110 | 1.0505 | 2.2136 | 1.072 |
| 300 | 1.0200 | 1.0086 | 1.0071 | 1.0043 | 1.0019 | 1.0099 | 1.0640 | 2.2258 | 1.080 |
| 400 | 1.0185 | 1.0080 | 1.0059 | 1.0042 | 1.0020 | 1.0089 | 1.0754 | 2.1506 | 1.085 |
| 500 | 1.0171 | 1.0075 | 1.0053 | 1.0039 | 1.0018 | 1.0081 | 1.0843 | 2.0601 | 1.088 |
| 700 | 1.0156 | 1.0067 | 1.0043 | 1.0037 | 1.0018 | 1.0071 | 1.0917 | — | 1.085 |
| 1000 | — | — | — | — | — | — | 1.0882 | — | — |
| Rm MPa | 1987 | 1831 | 1792 | 1815 | 1946 | 1740 | 1734 | 1644 | 138 |

*alloys of the invention
**comparison samples

Table 6 discloses that by cold working and precipitation hardening of an alloy of the invention it is possible, by strictly controlling the composition in cold rolled and precipitation hardened condition, to obtain a strength exceeding 1800 or even 1900 MPa combined with a very low value of the magnetic permeability 1.002–1.025. The inventive alloy thus enables using the property advantages given by a high strength for spring applications at the same time as the material is able to preserve its para-magnetic structure and thereby be useful in applications where a magnetic inert material is desired. The reference materials outside the composition ranges of this invention have lower values for both its mechanical properties and the effect of precipitation treatment while the magnetic permeability is higher. This is relevant for commercial alloys AISI 304/305.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is

1. Precipitation-hardenable non-magnetic steel alloy with high strength, comprising in percent by weight:

| | |
|---|---|
| C | 0.04–0.25% |
| Si | 0.1–2% |
| Mn | 2–15% |
| Cr | 16–20.37% |
| Ni | 8–14% |
| N | 0.10–1.5% |
| V | 1–2% |

the remainder being iron and normal impurities, the contents of said elements being balanced so that the austenite phase remains sufficiently stable so as to resist transformation into martensite during cold working, said steel alloy having a magnetic permeability of 1.025 or less after cold working.

2. The steel of claim 1, wherein the elements are balanced that the austenite phase remains sufficiently stable so as to resist any transformation into martensite at cold working >70% thickness reduction.

3. The steel of claim 1 wherein, the amount of nitrogen is 0.15–0.6%.

4. The steel of claim 1, wherein the amount of carbon is 0.04–0.20%.

5. The steel of claim 1, wherein the amount of silicon is 0.1–1%.

6. The steel of claim 1, wherein the amount of manganese is 4–7.5%.

7. The steel of claim 1, wherein the amount of manganese is 4–10%.

8. The steel of claim 1, wherein the amount of nickel is 9–12%.

9. The steel of claim 1, wherein the amount of nitrogen is 0.25–0.5%.

10. Precipitation-hardenable non-magnetic steel alloy with high strength, comprising in percent by weight:

| | |
|---|---|
| C | 0.04–0.25% |
| Si | 0.1–2% |
| Mn | 2–15% |
| Cr | 16–21% |
| Ni | 8–14% |
| N | 0.10–1.5% |
| V | 1–2% |

the remainder being iron and normal impurities, the contents of said elements being balanced so that the austenite phase remains sufficiently stable so as to resist transformation into martensite during cold working, said steel alloy having a magnetic permeability of 1.025 or less after cold working.

11. The precipitation-hardenable non-magnetic steel alloy of claim 10, including 0.1–0.25% C.

12. The precipitation-hardenable non-magnetic steel alloy of claim 10, including 0.5–2% Si.

13. The precipitation-hardenable non-magnetic steel alloy of claim 10, including 13–15% Mn.

14. The precipitation-hardenable non-magnetic steel alloy of claim 10, including 18–19% Cr.

15. The precipitation-hardenable non-magnetic steel alloy of claim 10, including 0.1–0.25% C and 0.5–2% Si.

16. Precipitation-hardenable non-magnetic steel alloy with high strength, comprising in percent by weight: 20

| | |
|---|---|
| C | ≦0.25% |
| Si | 0.5–2% |
| Mn | 2–15% |
| Cr | 16–21% |
| Ni | 8–14% |
| N | 0.10–1.5% |
| V | 1–2% |

the remainder being iron and normal impurities, the contents of said elements being balanced so that the austenite phase remains sufficiently stable so as to resist transformation into martensite during cold working, said steel alloy having a magnetic permeability of 1.025 or less after cold working and being free of ferrite and martensite after quench annealing.

17. The precipitation-hardenable non-magnetic steel alloy of claim 1, said alloy being free of ferrite and martensite after quench annealing.

18. The precipitation-hardenable non-magnetic steel alloy of claim 10, said alloy being free of ferrite and martensite after quench annealing.

* * * * *